US006547950B1

(12) United States Patent
Lorincz

(10) Patent No.: US 6,547,950 B1
(45) Date of Patent: Apr. 15, 2003

(54) CATHODE RINSING STATION AND METHOD

(75) Inventor: Thomas A. Lorincz, Hollister, CA (US)

(73) Assignee: Therma Corporation, Inc., San Jose, CA (US)

( * ) Notice: Subject to any disclaimer, the term of this patent is extended or adjusted under 35 U.S.C. 154(b) by 0 days.

(21) Appl. No.: 09/496,881

(22) Filed: Feb. 2, 2000

(51) Int. Cl.[7] ..... C25F 3/16; C25D 17/00; C25B 9/00

(52) U.S. Cl. ..... 205/640; 205/672; 205/705; 204/224 M; 204/225; 204/272; 204/275

(58) Field of Search ..... 204/272, 224 M, 204/225, 275; 205/640, 672, 705, 710

(56) References Cited

U.S. PATENT DOCUMENTS

| | | | | | |
|---|---|---|---|---|---|
| 2,764,540 | A | | 9/1956 | Farin et al. | 204/140.5 |
| 3,055,812 | A | | 9/1962 | Andersson | 204/140.5 |
| 3,076,754 | A | * | 2/1963 | Evans | 204/272 X |
| 3,329,596 | A | | 7/1967 | Abt et al. | 204/143 |
| 3,905,885 | A | * | 9/1975 | Bengel et al. | 204/272 X |
| 3,941,677 | A | * | 3/1976 | Bourne | 204/272 |
| 4,369,101 | A | | 1/1983 | Wolff et al. | 204/224 |
| 4,645,581 | A | | 2/1987 | Voggenthaler et al. | 204/275 |
| 4,705,611 | A | | 11/1987 | Grimes et al. | 204/129.1 |
| 4,772,367 | A | | 9/1988 | Menzel et al. | 204/129.5 |
| 4,826,582 | A | * | 5/1989 | Lavalerie et al. | 204/224 R X |
| 4,849,084 | A | * | 7/1989 | Vouzelland | 204/224 R |
| 5,135,625 | A | | 8/1992 | Lewy | 204/129.6 |
| 5,507,923 | A | | 4/1996 | Stouse et al. | 205/679 |
| 5,958,195 | A | * | 9/1999 | Lorincz et al. | 204/224 M |

* cited by examiner

*Primary Examiner*—Donald R. Valentine
(74) *Attorney, Agent, or Firm*—Henneman & Saunders; Larry E. Henneman, Jr.

(57) ABSTRACT

A cathode station (10) for a pipe electrochemical polishing system (12) has a valve (20) for preventing a cleaning fluid (56) from entering into a pipe (28). A cathode (14) is pulled into the cathode station (10) by a cathode puller cable (16) after a polishing operation (62) is completed. In a rinse cathode operation (66) the cleaning fluid (56) is introduced into the cathode station (10) through a fluid inlet (52) and removed from a fluid outlet (54). In a finish operation (68) the cathode (14) and cathode station (10) are removed from the pipe electrochemical polishing system (12).

15 Claims, 3 Drawing Sheets

CATHODE RINSING STATION AND METHOD

TECHNICAL FIELD

The present invention relates to the field of electrochemical processing, and more particularly to an apparatus for accepting and cleaning an electrode used in such a process. The predominant current usage of the present inventive cathode rinsing station is in the handling of a cathode used for in place electropolishing, wherein it is desirable to easily clean and store the electrode without exposing the user and others to an acid electrolyte which is on the cathode.

BACKGROUND ART

It is known in the art to deposit and/or remove materials by passing an electric current through a fluid electrolyte which is in contact with a conductive electrode. Materials are exchanged between the electrolyte and the electrode depending upon the direction of current flow and the ionization of materials to be deposited on or removed from the electrode. Electroplating is a well known application of this general method. Electropolishing is also well known in the art. In the electropolishing process, irregularities and deposits on a surface are removed by causing such to be drawn into the electrolyte solution.

An example is the in place electrochemical polishing of a pipe. In such an example, a cathode is drawn through the pipe while an electrolyte solution is simultaneously piped through the pipe. The pipe acts as an anode and is electrochemically polished in the process. Since the electrolyte solution must be continuously pumped through the pipe during the process, it is most practical to recirculate the solution.

The electrolyte solution used in such a process is generally an acid which is sufficiently concentrated to be a hazard both to personnel and equipment. Therefore, when the cathode is withdrawn from the pipe, it is covered with an acid which can damage the cathode and which can injure persons who might handle the cathode. The cathode can be carefully cleaned, but this process, itself, is somewhat dangerous, as splashing and the like may occur during the process. Furthermore, the longer the delay between the removal of the cathode from the acid electrolyte and the time when it is eventually cleaned, the more wear will occur to the cathode and the more likely it is that the acid on the cathode can damage equipment and/or personnel.

It would be valuable to have a method or apparatus whereby the cathode would not emerge from the process covered with the harmful acid electrolyte. However, to the inventor's knowledge, no such has existed in the prior art.

DISCLOSURE OF INVENTION

Accordingly, it is an object of the present invention to provide an apparatus and method for cleaning the cathode in an electropolishing process without exposing equipment or personnel to a harmful acid electrolyte.

It is still another object of the present invention to provide an apparatus and method for reducing the risk to equipment and personnel associated with removing a cathode from an in place polishing system, It is yet another object of the present invention to provide an apparatus and method for reducing the time, effort and expense of an in place polishing process.

It is still another object of the present invention to provide an apparatus and method for prolonging the useful life of a cathode used in an in place polishing process.

Briefly, a known embodiment of the present invention is an improved in place electropolishing apparatus for polishing a pipe. According to the present invention, a cathode station is positioned such that the cathode will come to rest in the cathode station after the cathode is fully drawn through the pipe. A valve prevents leakage between the cathode and the pipe. A cleaning fluid is pumped into the cathode station at one and withdrawn at the other end until the cathode is rinsed free of acid.

An advantage of the present invention is that it is much easier for operators to clean and store the cathode after an in place polishing process.

A further advantage of the present invention is that the cathode can be cleaned immediately after use.

Yet another advantage of the present invention is that personnel and equipment are not exposed to acid that might drip from the cathode after it is removed from the pipe.

Still another advantage of the present invention is that it is economical to manufacture and to use.

These and other objects and advantages of the present invention will become clear to those skilled in the art in view of the description of modes of carrying out the invention, and the industrial applicability thereof, as described herein and as illustrated in the several figures of the drawing. The objects and advantages listed are not an exhaustive list of all possible objects or advantages of the invention. Moreover, it will be possible to practice the invention even where one or more of the intended objects and/or advantages might be absent or not required in the application.

Further, those skilled in the art will recognize that various embodiments of the present invention may achieve one or more, but not necessarily all, of the above described objects and advantages. Accordingly, the listed objects and/or advantages are not essential elements of the present invention, and should not be construed as limitations.

DETAILED DESCRIPTION OF THE INVENTION

Figure 1:
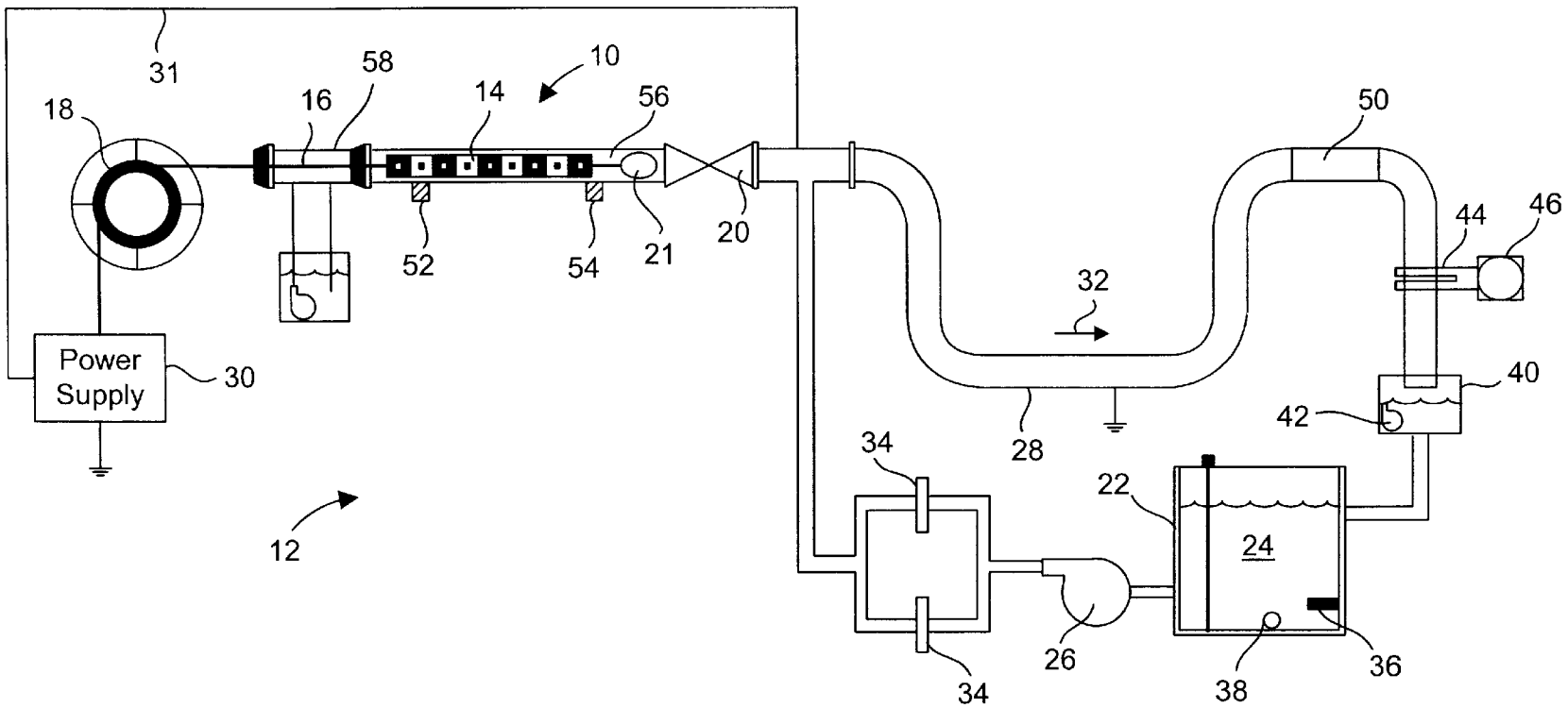
FIG. 1 is block diagrammatic view of an example of an in place pipe electropolishing system having a cathode station according to the present invention.

The embodiments and variations of the invention described herein, and/or shown in the drawings, are presented by way of example only and are not limiting as to the scope of the invention. Unless otherwise specifically stated, individual aspects and components of the invention may be omitted or modified, or may have substituted therefore known equivalents, or as yet unknown substitutes such as may be developed in the future or such as may be found to be acceptable substitutes in the future. The invention may also be modified for a variety of applications while remaining within the spirit and scope of the claimed invention, since the range of potential applications is great, and since it is intended that the present invention be adaptable to many such variations.

Unless otherwise stated herein, component parts of the invention will be familiar to one skilled in the art, and may be purchased or readily manufactured accordingly. Also, unless otherwise stated herein, substitutions can be made for the components described, and each of the individual components, except as specifically claimed, is not an essential element of the invention.

A known mode for carrying out the invention is a cathode station 10 which is, in this example, as part of an in place pipe electrochemical polishing system 12. The in place pipe electrochemical polishing system 12 is depicted in a block schematic diagrammatic view in FIG. 1. As one skilled in the art will recognize, some of the relevant component parts of the in place pipe electrochemical polishing system are a cathode 14, a cathode puller cable 16, a cable puller 18, a valve 20, a dam 21, an electrolyte reservoir 22 for containing a supply of an electrolyte 24, and an electrolyte pump 26, all of which are provided for the purpose of polishing the interior of a pipe 28. In the electrochemical polishing process, the cathode 14 is drawn toward the cable puller 18 by the cathode puller cable 16, while current is applied through the cathode 14 from a power supply 30. The current flows through the electrolyte 24 in the pipe 28, which shares a common ground with the power supply 30 such that the pipe 28 acts as an anode and the interior thereof is polished, according to the known principles of electropolishing. A ground wire 31 provides a good ground from the power supply 30 to the pipe 28. During the process, the electrolyte 24 is pumped to flow through the pipe 28 in a direction 32 opposite that in which the cathode 14 is being drawn. The valve 20 prevents the electrolyte 24 from escaping the pipe 28 while allowing the cathode puller cable 16 to be pulled therethrough. The dam 21 is a ball which generally restricts and directs flow of fluid past the dam 21.

In the example of the in place polishing system 12 in which the present invention is depicted as being embodied, two filters 34 are placed in the path of the electrolyte to insure that particulate matter removed from the inside of the pipe 28 is removed from the electrolyte 24 solution as it is recirculated through the in place polishing system 12 by the electrolyte pump 26. A lesser or greater quantity of the filters 34 could be used, as necessary or desirable according to the application.

In the example of the system shown in FIG. 1, an electric heater 36 and temperature indicating control 38 are provided in the path of the electrolyte 24. In this example, the electric heater 36 and the temperature indicating control 38 are located in the electrolyte reservoir 22. Also, in the present example of the invention, a collector sump 40 catches the electrolyte 24 at it flows out of the pipe 28, and a collector sump pump 42 pumps the electrolyte 24 from the collector sump 40 to the electrolyte reservoir 22. A heat exchanger 44 is provided in the path of the electrolyte 24 with a chiller 46 operatively connected thereto. The chiller 46 is a conventional refrigeration unit and pump, and the heat exchanger 44 is adapted to transfer heat from the electrolyte 24 in the pipe 28 to the chiller 46. In the view of FIG. 1, the cathode station 10 is depicted with the cathode 14 therein. According to the present invention, the cathode 14 has been drawn through the pipe 28 from an expendable section 50 located at the distal end of the pipe 20. When the cathode 14 has been fully drawn through the pipe 28, it is pulled through the valve 20 into the cathode station 10, which is provided for this purpose.

Figure 2:
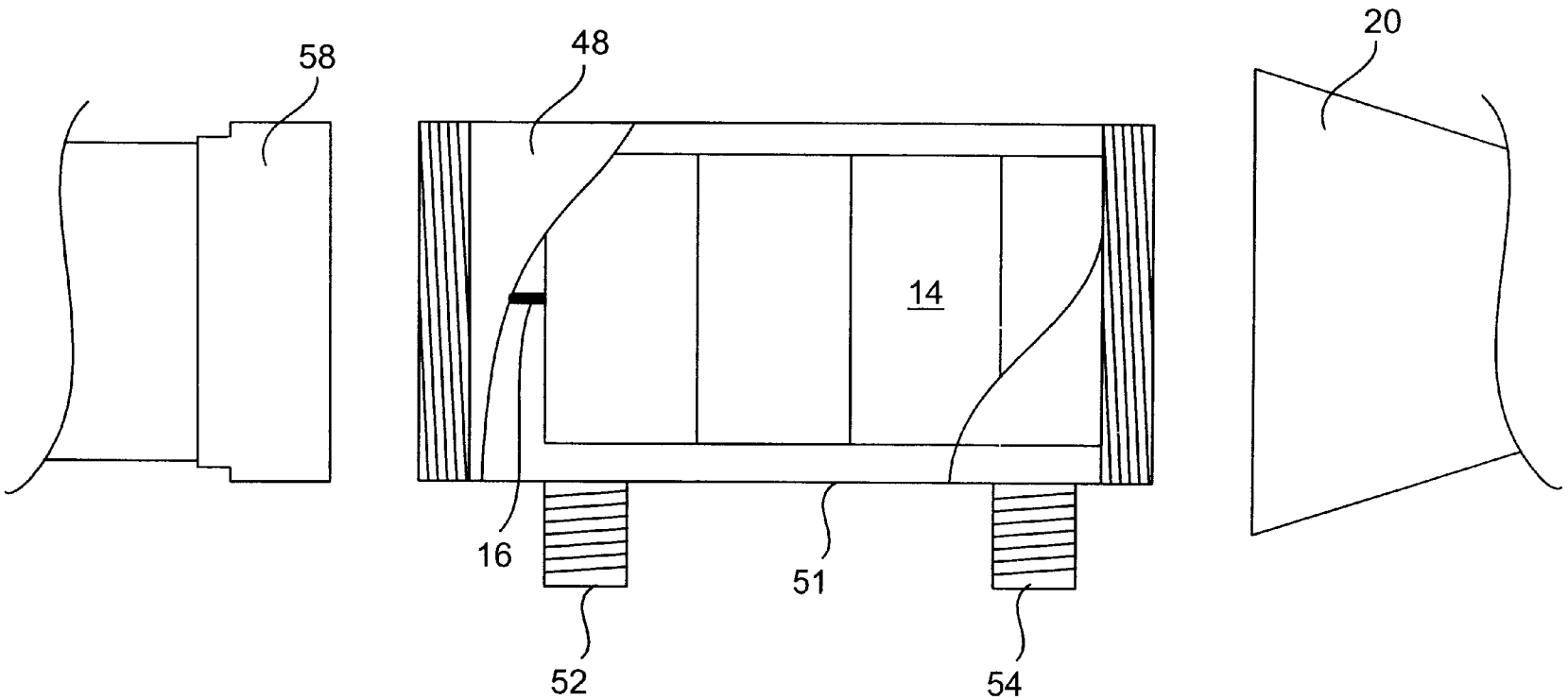
FIG. 2 is a more detailed cross sectional diagrammatic view of the cathode station of FIG. 2.

FIG. 2 is a more detailed cross sectional diagrammatic view of the cathode station 10, with the cathode 14 therein. In the view of FIG. 2 it can be seen that the cathode station 10 has generally cylindrical station body 51 with a fluid inlet 52 and a fluid outlet 54 disposed on the side thereof, with the fluid inlet 52 being near one end of the station body 51 and the fluid outlet 54 being near the other end of the station body 51. After the in place polishing process is completed and the cathode is in place in the cathode station 10, a cleaning fluid 56 is introduced into the cathode station 10 through the fluid inlet 52. In the present example, the cleaning fluid 56 is tap water. The cleaning fluid 56 generally fills the cathode station 10 and exits therefrom through the fluid outlet 54. The fluid inlet 52 will generally be connected to a source of clean water (such as a tap from a city water supply) and other fluid sources, as discussed elsewhere herein. The fluid outlet 54 will be connected to recycle the fluid. Alternatively, the fluid outlet 54 could be connected to an approved disposal, such as a container wherein water run through the cathode station 10 can be later removed to a proper disposal site and disposed of according to applicable regulations and safety standards.

The cathode station is continuously flushed, as described, for several minutes. One skilled in the art will recognize that, in practice, the electropolishing operation described previously, herein, is followed by a rinsing operation, wherein the pipe 28 is rinsed with fresh water. Therefore, it is thought by the inventor that it will be most practical to continue flushing the cathode station 10 during the duration of the conventional rinse operation during which the pipe 28 is rinsed. One skilled in the art will also recognize that the rinsing of the pipe 28 can be followed by a drying operation in which the pipe 28 is dried with air, nitrogen, or the like. Although the presently described embodiment of the invention does not include specifically drying the cathode station 10, because this is not presently thought to be necessary, it is certainly within the scope of the invention to follow the rinsing of the cathode station 10 by drying the cathode station 10 using the available air, nitrogen, or the like, which is used to dry the pipe 28.

In the example of the invention depicted in FIG. 2, the cathode station 10 is threaded to accept the valve 20 at one end thereof, and a cable rinse section 58 at the other end thereof. However, the method of attachment is not a necessary aspect of the invention and attachment by hose type clamps, or other means, is entirely within the scope of the invention.

Figure 3:
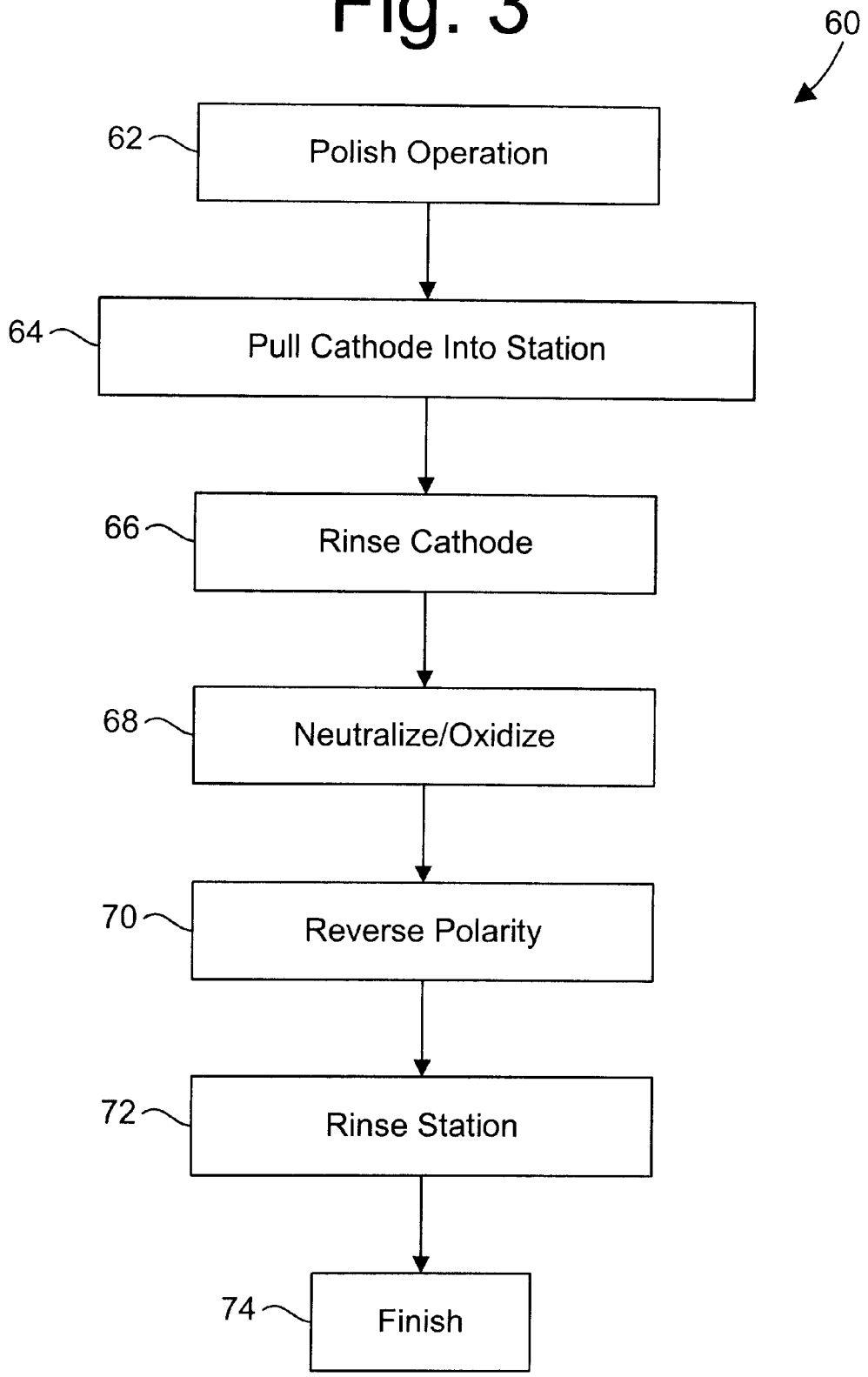
FIG. 3 is a flow diagram showing an example of a cathode cleaning method according to the present invention.

FIG. 3 is a flow diagram depicting relevant operations of an example of the inventive cathode cleaning method 60. A polish operation 62 is not a part of the present inventive method, and is included in the example of FIG. 3 merely to indicate that the present inventive method 60 will normally follow such polish operation 62. The polish operation 62 is that operation, discussed previously herein, wherein the cathode 14 is drawn through the pipe 28 while current is applied thereto for the purpose of polishing the interior of the pipe 28.

In a pull cathode into station operation 64 the cathode 14 is pulled into the cathode station 10 to rest in the position depicted in FIGS. 1 and 2. The valve 20 is adapted to allow the cathode 14 to be pulled therethrough, while sealing the passage between the cathode station 10 and the pipe 28 after the cathode 14 is fully within the cathode station 10. The valve 20 is not unique to the present invention.

In a rinse cathode operation 66, the cleaning fluid 26 (water, in this example) is introduced into the cathode station 10 through the fluid inlet 52 and exits from the cathode station 10 through the fluid outlet 54. As previously discussed, herein, the duration of this operation will generally be that of the rinse operation associated with the polish operation 62, and is not critical, so long as the duration is sufficient to thoroughly rinse the cathode 14.

In an optional neutralize/deoxidize operation, a neutralizing and/or deoxidizing solution, such as a sodium hydroxide (NaOH) solution is introduced into the cathode station 10 to neutralize the acidity within, and further to clean oxidation from the cathode 14. It should be noted that considerable oxidation can occur on the cathode 14, since it is generally constructed of copper in the presently described embodiment of the invention. Oxidation, in the form of scale, could be reduced by using some other material, such as stainless steel, in the construction of the cathode. However, copper is used in the presently described embodiment of the invention, because of its superior conduction characteristics.

In a reverse polarity operation 70, polarity of current through the cathode 14 is reversed such that any scale (oxidation) thereon will tend to be pulled from the cathode 14 and deposited on the interior of the cathode station 10. This is not harmful, since the oxidation is easily removed from the stainless steel cathode station 10. In a rinse station operation 72, current through the cathode 14 is stopped and water is introduced into the cathode station 10 to rinse the oxidation and neutralizing solution from the cathode station 10. It should be noted that it is within the scope of the invention that the neutralize/deoxidize operation 68 can continue and operation simultaneously with the reverse polarity operation 70.

In a finish operation 74 the cathode 4 is removed from the pipe electrochemical polishing system 12. In the present example, the cathode station 10 and the cathode 14 are removed as a unit, although it is within the scope of the invention that the cathode 14 be disassembled from and removed from the cathode station 14 as the pipe electrochemical polishing system 12 is, itself, disassembled to allow for the normal usage of the pipe 28.

Various modifications to the inventive method are also quite possible, while remaining within the scope of the invention. For example, the size, location, means of attachment and shape of the cathode station 10 are not essential elements of the invention.

It should be noted, as one skilled in the art will recognize, that the electrolyte 24 is an acid and, therefore, all components which come into contact with the electrolyte 24 should be selected to be capable of withstanding the acid. Furthermore, users of the invention should take the appropriate and necessary precautions for handling the electrolyte 24.

All of the above are only some of the examples of available embodiments of the present invention. Those skilled in the art will readily observe that numerous other modifications and alterations may be made without departing from the spirit and scope of the invention. Accordingly, the disclosure herein is not intended as limiting and the appended claims are to be interpreted as encompassing the entire scope of the invention.

INDUSTRIAL APPLICABILITY

The inventive cathode station is intended to be widely used with in place electrochemical processing systems. While the invention could be adapted for use with many types of such systems, it is intended initially for use with in place electropolishing systems adapted for polishing the interior of a pipe.

Since the inventive cathode station 10 of the present invention may be readily produced and integrated with existing electropolishing devices, and since the advantages as described herein are provided, it is expected that it will be readily accepted in the industry. For these and other reasons, it is expected that the utility and industrial applicability of the invention will be both significant in scope and long-lasting in duration.

What is claimed is:

1. In an apparatus for polishing a pipe, a station for receiving an electrode, comprising:

a station body adapted for accepting the electrode;

a fluid inlet on the station body adapted for admitting a fluid into the station body;

a fluid outlet on the station body adapted for removing the fluid from the station body; and a valve for separating the station body from the pipe such that the electrode can be drawn into the station body from the pipe through the valve.

2. The station of claim 1, wherein:

the electrode is a cathode.

3. The station of claim 1, wherein:

the station body is generally cylindrical in shape.

4. The station of claim 1, wherein:

the fluid inlet and the fluid outlet are generally disposed at opposite ends of the station body.

5. A cathode station for cleaning a cathode in a pipe, comprising:

a receptacle adapted for receiving a cathode;

a fluid inlet affixed to said receptacle and adapted for admitting a fluid into said receptacle;

a fluid outlet affixed to said receptacle and adapted for removing the fluid from said receptacle; and a valve for separating the receptacle from the pipe such that the cathode can be drawn from the pipe into the receptacle, and further such that the fluid can be prevented from flowing between the pipe and the receptacle.

6. The cathode station of claim 5 and further including:

a valve affixed to one end of the receptacle, said valve being adapted for preventing the fluid from escaping the receptacle.

7. The cathode station of claim 5, wherein:

the cathode is adapted for in place electropolishing.

8. A method for handling an electropolishing cathode in a pipe, comprising:

moving the cathode from the pipe into a receptacle; and flowing a fluid through the receptacle.

9. The method of claim 8, wherein:

the fluid is water.

10. The method of claim 8, wherein:

the cathode is drawn through a valve into the receptacle.

11. The method of claim 8, wherein:

the cathode is drawn into the receptacle by a cable.

12. The method of claim 8, wherein:

the fluid flows from a fluid inlet on the receptacle, through the receptacle, and out of a fluid outlet on the receptacle.

13. The method of claim 8, and further including:

rinsing the cathode within the receptacle.

14. The method of claim 8, and further including:

deoxidizing the cathode within the receptacle.

15. The method of claim 8, and further including:

passing electrical current through the cathode when the cathode is in the pipe; and reversing the current through the cathode within the receptacle.

* * * * *